US012616890B2

(12) United States Patent
Fan

(10) Patent No.: US 12,616,890 B2
(45) Date of Patent: May 5, 2026

(54) AUXILIARY DEVICE FOR PRACTICING GOLF SWING POSTURE

(71) Applicant: Eagle Fan, Chu-Pei City (TW)

(72) Inventor: Eagle Fan, Chu-Pei City (TW)

( * ) Notice: Subject to any disclaimer, the term of this patent is extended or adjusted under 35 U.S.C. 154(b) by 317 days.

(21) Appl. No.: 18/424,901

(22) Filed: Jan. 29, 2024

(65) Prior Publication Data

US 2025/0242224 A1 Jul. 31, 2025

(51) Int. Cl.
*A63B 69/36* (2006.01)

(52) U.S. Cl.
CPC ..... *A63B 69/3632* (2013.01)

(58) Field of Classification Search
CPC ..... A63B 69/3632
See application file for complete search history.

(56) References Cited

U.S. PATENT DOCUMENTS 3,565,444 A * 2/1971 La Rocca ..... A63B 69/3632 473/228
6,440,005 B1 * 8/2002 Hubenig ..... A63B 69/3632 473/228
7,285,055 B2 * 10/2007 Radle ..... A63B 69/3632 473/226

* cited by examiner

*Primary Examiner* — Brian O Peters

(57) ABSTRACT

An auxiliary device for practicing golf swing posture is provided, including: a housing, having a first housing base and a second housing base in an open manner; a clamping assembly, installed on the first housing base, and for clamping onto a shaft of a golf club; and a sector assembly, folded and stacked into a long square multi-layered structure forming an sector-shaped fan after unfolding. As such, when the user performs swing practice, the expanded arc-shaped fan surface is used to assist in maintaining the correct club-holding posture during the swing process.

10 Claims, 8 Drawing Sheets

AUXILIARY DEVICE FOR PRACTICING GOLF SWING POSTURE

BACKGROUND OF THE PRESENT INVENTION

1. Field of the Present Invention

The present invention relates generally to an auxiliary training device for golf, and more particularly, to an auxiliary device for practicing golf swing posture.

2. The Prior Arts

Golf players know that the correctness of the swing posture is very important. First, the player must adjust the stance from the tee off, and then the tee off and backswing to the top position of the backswing. This process starts with the upper body drives the lower body to move, and then changes from the top position of the backswing to the downswing position, followed by impact, follow-through to the final closing position. This process is the lower body driving the upper body to move. The process needs to be executed through the coordination and integration of muscles in all parts of the whole body from head to toe, including the upper and lower body, and the rotation of the head, arms, wrists, shoulders and waist to the shift of the center of gravity of the feet to fully release the power of the club head and hit the ball in an accurate direction and distance. It takes constant practice and correction before a player can master the trick. Generally, when beginners perform swing exercises, they will first ask a coach to help to guide and correct the swing movements and postures so that the club head can be on the correct path of the backswing or downswing phases during the swing. However, due to the swing path is an invisible abstract concept determined only by the coach's own experience, it is therefore often impossible to effectively and accurately pin point the problem with the movement. In addition, during subsequent self-practice without a coach, the club-holding hand posture is hard to maintain. Also, because of persistent swing practice, it is easy to develop the wrong swing posture, making it even more difficult to correctly adjust the posture in the future.

SUMMARY OF THE PRESENT INVENTION

A primary objective of the present invention is to provide an auxiliary device for practicing golf swing posture that allows the user to correctly hold the club and move to the backswing position after the tee off, or to maintain the posture of holding the club during the downswing from the backswing position, impact the ball, and follow-through, so as to maintain the correct posture, and then grow accustomed to and develop the correct swing execution.

In order to achieve the above objective, the present invention provides an auxiliary device for practicing golf swing posture, comprising: a housing, having a first housing base and a second housing base in an open manner; a clamping assembly, installed on the first housing base, and for clamping onto a shaft of a golf club; and a sector assembly, folded and stacked into a long square multi-layered structure forming an sector-shaped fan after unfolding.

In a preferred embodiment, the clamping assembly comprises a pair of clamps and a control knob; the pair of clamps is disposed on the first housing base and can be opened or closed; the control knob is disposed on the first housing base and is connected with the pair of clamps; when the control knob rotates, the pair of clamps is opened or closed.

In a preferred embodiment, semi-circular arc-shaped jaws are disposed on wall surfaces of the pair of clamps facing each other.

In a preferred embodiment, an elastic member is disposed at a pivot joint of the pair of clamps and the first housing base, the elastic member is in contact with the pair of clamps and the pair of clamps is driven by the elastic member to open in the absence of external force.

In a preferred embodiment, the clamping assembly further comprises a top latch, located in the first housing base and able to move over a short distance without breaking away; the top latch is embedded with a nut, and the control knob is provided with a screw; after assembly, the screw penetrates the first housing base and extends into the first housing base to connect with the nut; the screw is driven to rotate by rotating the control knob, and the top latch is synchronously driven to move because the screw is connected to the nut.

In a preferred embodiment, the pair of clamps has an inclined surface facing an end connecting to the top latch, the top latch has a guide surface with double inclined surfaces corresponding to each inclined surface respectively, and the pair of clamps is opened or closed according to different contact states between the guide surface and the inclined surfaces of the clamps.

In a preferred embodiment, the sector assembly comprises a locking unit, a plurality of fan ribs and a fan cloth; the fan cloth is arc-shaped and adheres to the plurality of the fan ribs, and the fan ribs are stacked together with one end locked together by the locking unit; when the locking unit is in an unlocked state, the plurality of fan ribs can be stacked together after folding, or can form an arc-shaped fan by unfolding the fan ribs and the fan cloth; and, when the locking unit is in a locked state, the positions of the plurality of fan ribs are fixed together.

In a preferred embodiment, both sides of the outermost periphery of the plurality of fan ribs are respectively a first side fan rib and a second side fan rib, the locking unit comprises a first fixing member, a second fixing member, a locking screw, and a locking knob, the first fixing member is fixed on one end of the first side fan rib, the second fixing member is fixed on one end of the second side fan rib at a corresponding position, and the first fixing member and the second fixing member are clamped to the first side fan rib, the reset of the plurality of the fan ribs and the second side fan rib, the locking screw penetrates the second housing base to secure the first fixing member, the first side fan ribs, the rest of the plurality of fan ribs, the second side fan ribs, and the second fixing member connected in series, and the locking screw is screwed to the locking knob.

In a preferred embodiment, a wall surface of the second housing base facing the first fixing member has a first side tooth surface, the first fixing member facing the wall surface of the first side tooth surface has a first tooth surface, and the first side tooth surface meshes with the first tooth surface when the locking unit is locked.

In a preferred embodiment, an auxiliary member is disposed on the second housing base in a direction facing the second fixing member, a wall surface of the auxiliary member facing the second fixing member has a second side tooth surface, a wall surface of the second fixing member facing the second side tooth surface has a second tooth surface, and the second side tooth surface meshes with the second tooth surface when the locking unit is locked.

As seen in the above structure, the auxiliary device for practicing golf swing posture according to the present invention is to be fixed on the shaft of the golf club. After unfolding, the sector assembly has an arc-shaped fan surface, whereby the arc-shaped fan surface guides the swing smoothly, and the correct swing posture is maintained during the swing execution because the unfolded arc-shaped fan cloth will guide the club to swing smoothly along the elliptical trajectory, thereby helping the user to develop correct swing habits.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The technical solutions of the present invention will be described clearly and completely below in conjunction with the specific embodiments and the accompanying drawings. It should be noted that when an element is referred to as being "mounted or fixed to" another element, it means that the element can be directly on the other element or an intervening element may also be present. When an element is referred to as being "connected" to another element, it means that the element can be directly connected to the other element or intervening elements may also be present. In the illustrated embodiment, the directions indicated up, down, left, right, front and back, etc. are relative, and are used to explain that the structures and movements of the various components in this case are relative. These representations are appropriate when the components are in the positions shown in the figures. However, if the description of the positions of elements changes, it is believed that these representations will change accordingly.

Unless otherwise defined, all technical and scientific terms used herein have the same meaning as commonly understood by one of ordinary skill in the art of the present invention. The terminology used herein is for the purpose of describing particular embodiments only and is not intended to limit the present invention. As used herein, the term "and/or" includes any and all combinations of one or more of the associated listed items.

Figure 1:
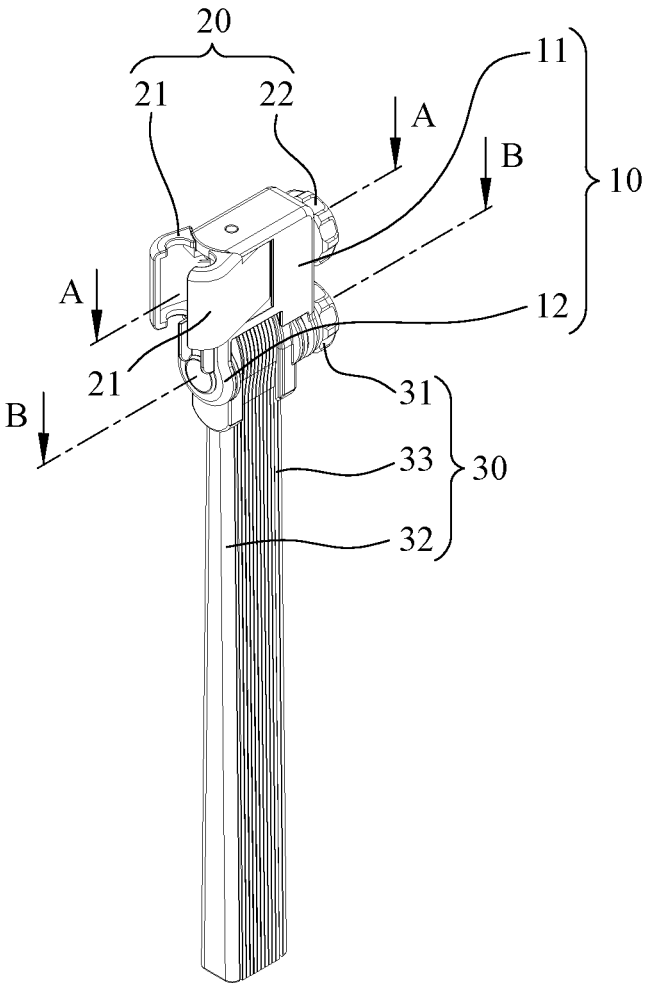
FIG. 1 is a three-dimensional view of the folded sector assembly of the present invention.
Figure 2:
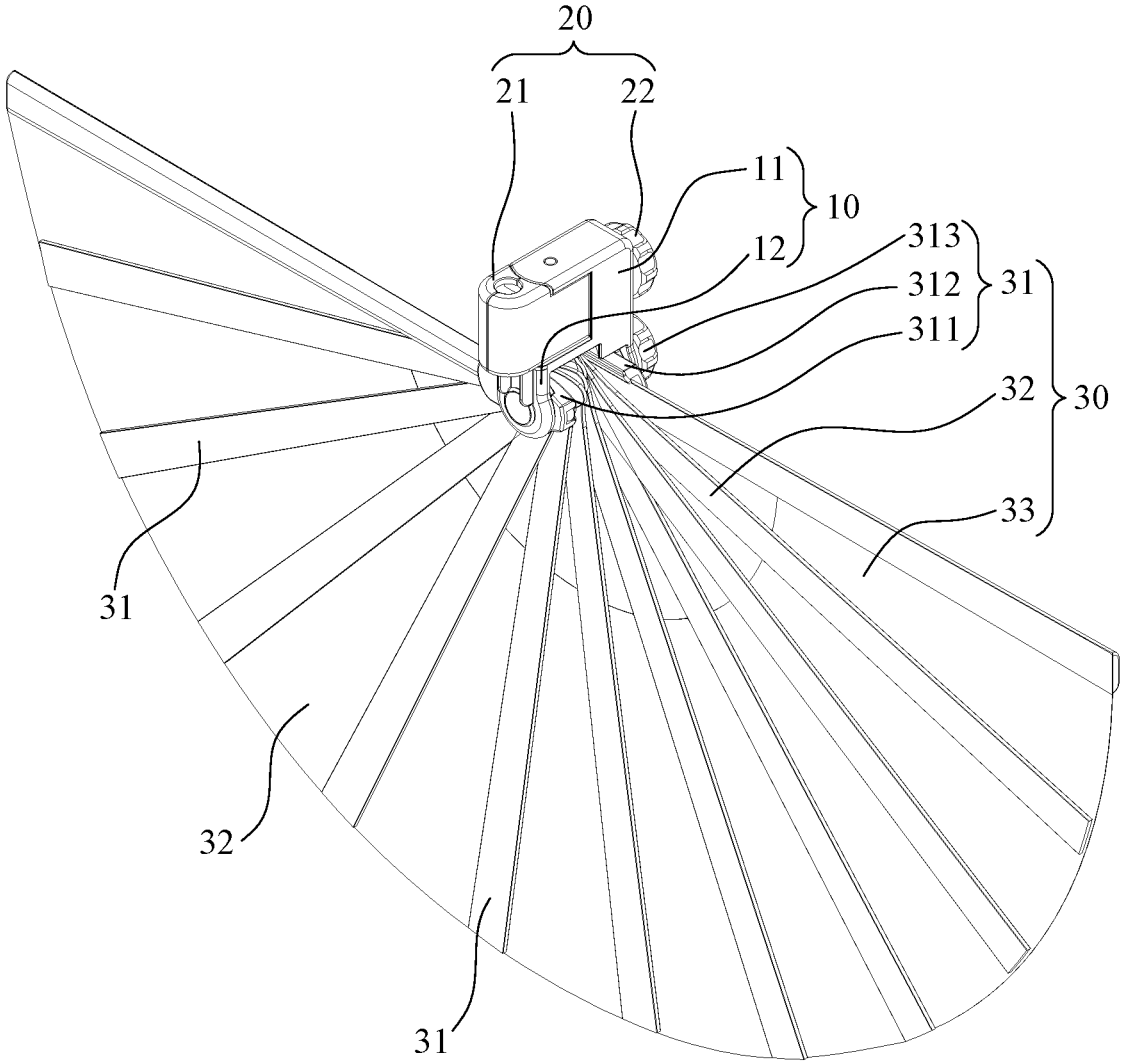
FIG. 2 is a three-dimensional view of the unfolded sector assembly of the present invention.

FIGS. 1 and 2 are three-dimensional views of the folded and unfolded sector assembly of the auxiliary device for practicing golf swing posture of the present invention. The auxiliary device for practicing golf swing posture of the present invention includes a housing 10, a clamping assembly 20 and a sector assembly 30. The housing 10 has a first housing base 11 and a second housing base 12. The first housing base 11 and the second housing base 12 have open spaces for installing the clamping assembly 20 and the sector assembly 30. The clamping assembly 20 is installed on the first housing base 11, and the clamping assembly 20 is used to clamp unto the shaft of a golf club. The sector assembly 30 is installed on the second housing base 12. As shown in FIG. 1, the sector assembly 30 is folded and stacked into a rectangular multi-layered structure. As shown in FIG. 2, the sector assembly 30 is unfolded to form an arc-shaped fan, whereby the sector assembly 30 has an arc-shaped fan surface parallel to the shaft of the club when the clamping assembly 20 is fixed to the shaft. As such, when the user swings the club, the arc-shaped fan surface can be used to guide the user's posture of holding the club without changing arbitrarily, thereby maintaining the correct position of the posture, of club-holding and then becoming accustomed to develop the correct swing posture.

Next, the structure of each component will be explained. Please refer to both FIG. 3 and FIG. 4:

The first housing base 11 and the second housing base 12 of the housing 10 are connected in an open manner. The first housing base 11 forms a first open chamber 111. The first open chamber 111 provides the clamping assembly 20 to be disposed herein, and the second housing base 12 forms a second open chamber 121. The opening direction of the second open chamber 121 is perpendicular to the first open chamber 111. The second open chamber 121 is for the sector assembly 30 to be disposed herein.

The clamping assembly 20 includes a pair of clamps 21 and a control knob 22. The pair of clamps 21 are pivotally connected to each other via an axis 23 and are disposed on the first housing base 11 and located in the first open chamber 111. The pair of clamps 21 can be opened or closed with the axis 23 as the center. The control knob 22 is located outside the first housing base 11 and is linked with the pair of clamps 21 for movement. When the control knob 22 is rotated, the pair of clamps 21 can be opened or closed. In order to facilitate the clamping of the cylindrical shaft of the club, the pair of clamps 21 has semi-circular arc-shaped jaws 211 on the respective facing walls. The two jaws 211 are close to form a circle when clamping, but the radius of the formed circle is smaller than the radius of the shaft of the club. An elastic member 24 is provided at the axial joint between the pair of clamps 21 and the first housing base 11. The elastic member 24 is a spring. In the present embodiment, the center of the elastic member 24 is penetrated by the axis 23, and the elastic member 24 is a spring. The two ends of the elastic member 24 are in contact with the pair of clamps 21, and the pair of clamps 21 will be driven by the elastic member 24 to open in the absence of external force.

Figure 5:
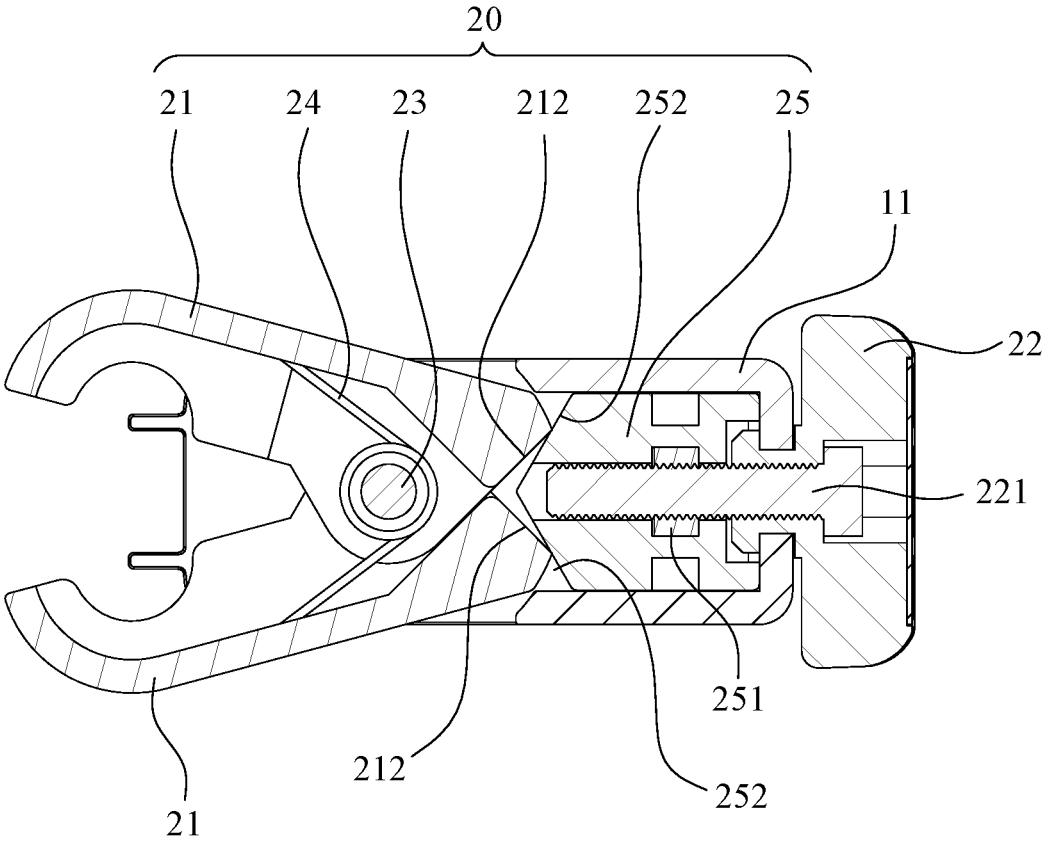
FIG. 5 is an enlarged cross-sectional view of the AA plane in FIG. 1.
Figure 6:
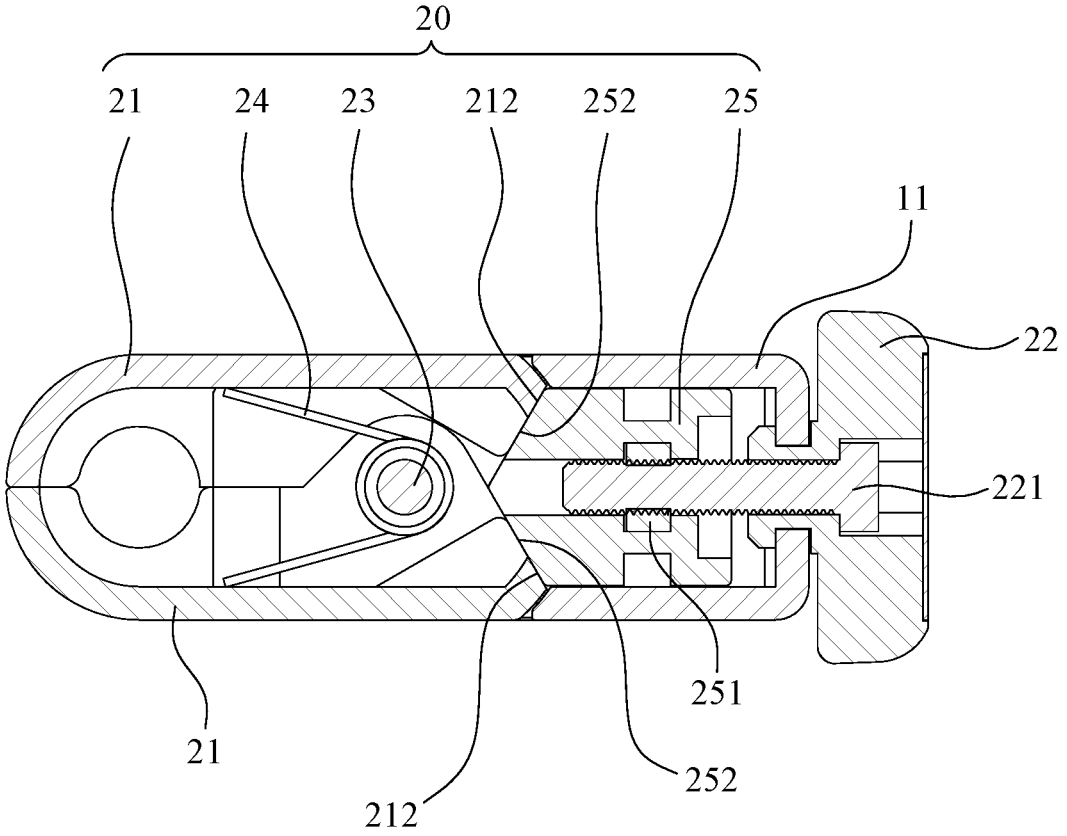
FIG. 6 is an enlarged cross-sectional view of the clamping state in FIG. 5.

Refer to both FIG. 5 and FIG. 6. The clamping assembly 20 also includes a top latch 25. The top latch 25 is located in the first open chamber 111. The top latch 25 is limited to only move in a short distance and will not break away from the first housing base 11. A nut 251 is embedded in the top latch 25. The control knob 22 is provided with a screw 221 to match the nut 251. After assembly, the screw 221 will penetrate the first housing base 11 and extend into the first open chamber 111 and connecting with the nut 251, so that turning the control knob 22 can drive the screw 221 to rotate. As the screw 221 is connected with the nut 251, the top latch 25 is driven to move. In addition, the wall surface of each clamp 21 facing the top latch 25 has an inclined surface 212. The top latch 25 has a guide surface 252 with double inclined surfaces. The double inclined surfaces of the guide surface 252 correspond to the inclined surface 212 of each clamp 21, respectively. As shown in FIG. 6, when the top latch 25 moves towards the pair of clamps 21, as the guide surface 252 contacts the inclined surface 212, the two clamps 21 are moved to become closed. As shown in FIG. 5, after the top latch 25 is retracted and driven by the elastic member 24, the pair of clamps 21 is opened.

Figure 3:
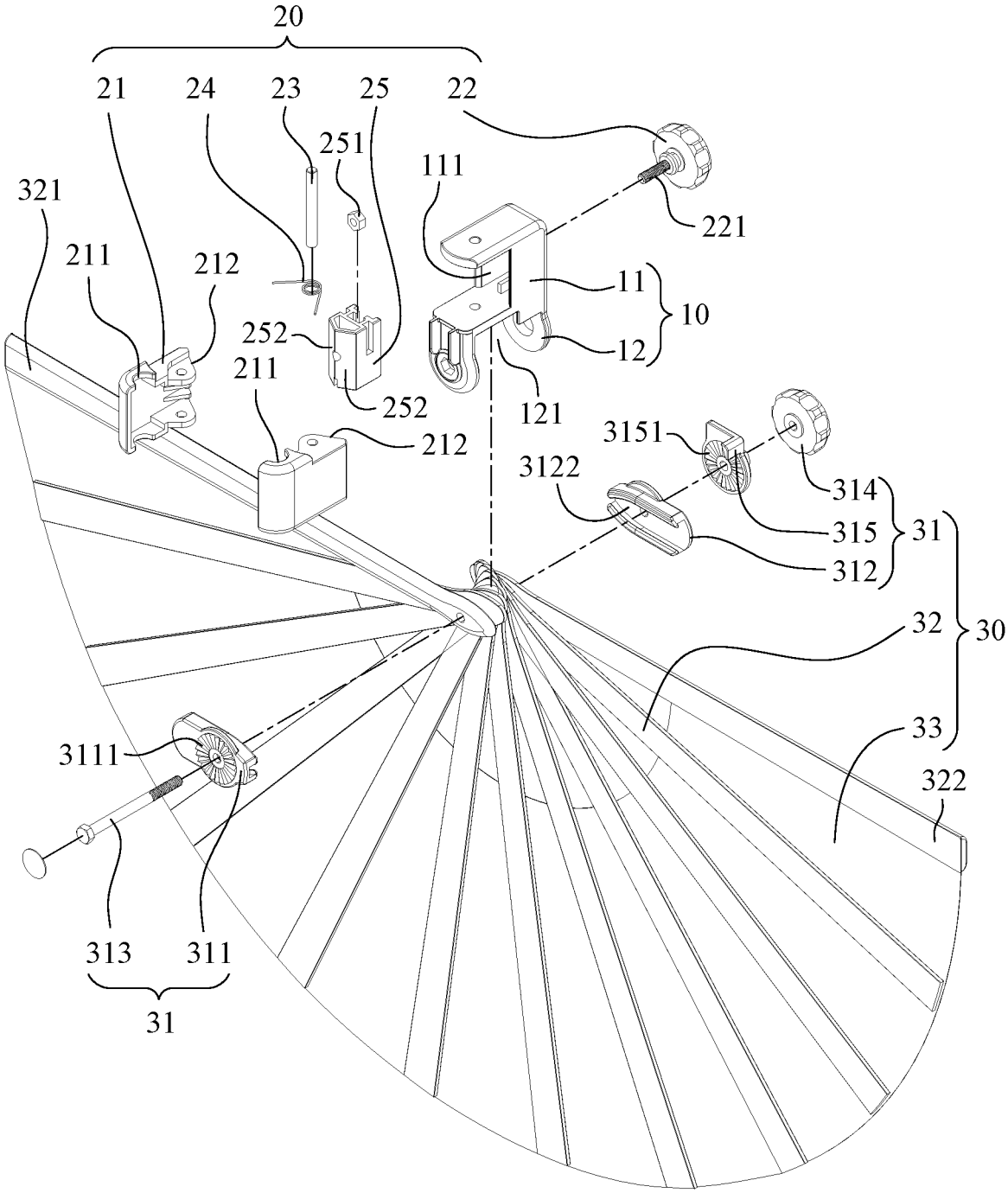
FIG. 3 is an exploded view of the present invention.
Figure 4:
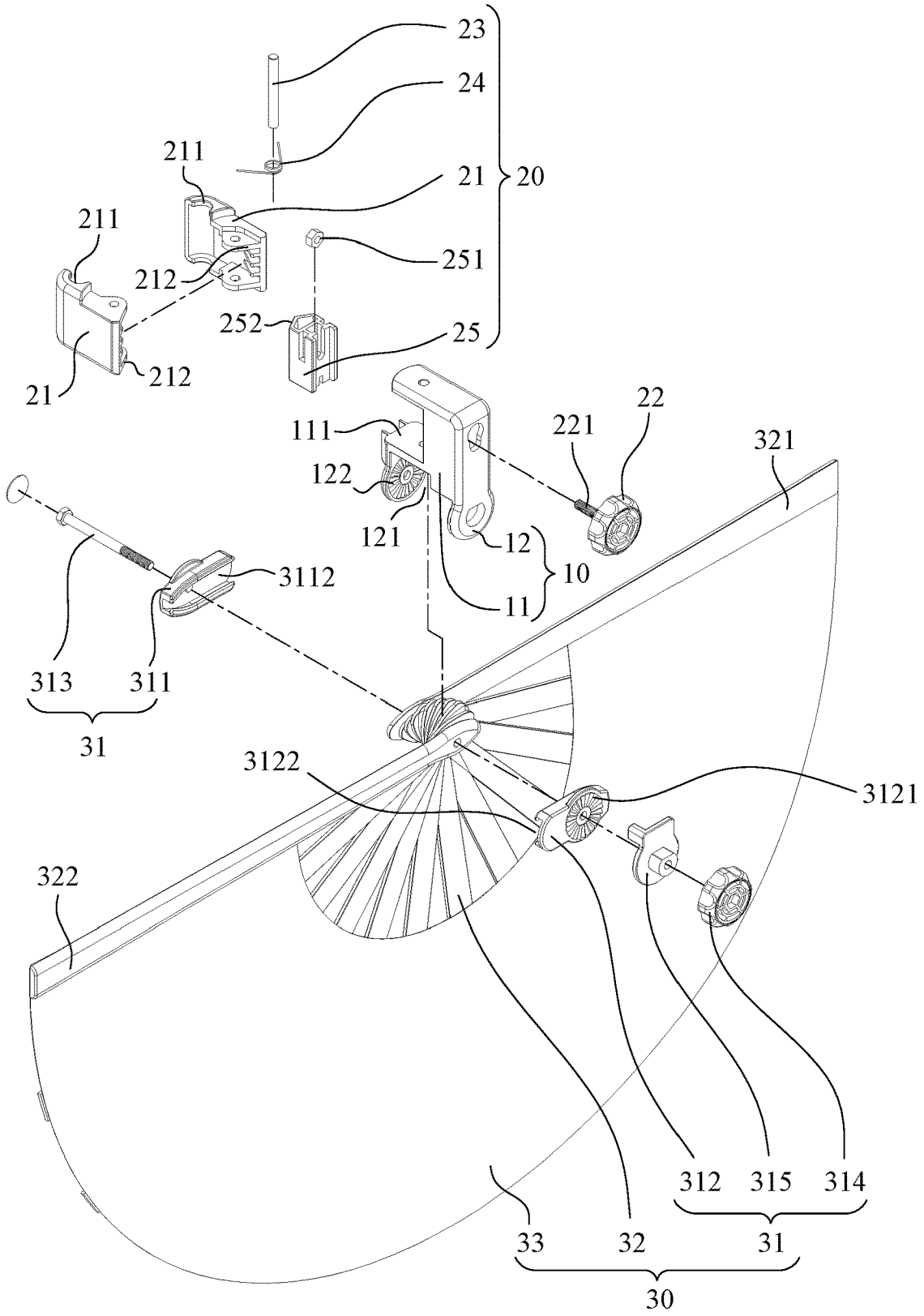
FIG. 4 is an exploded view of another angle of the present invention.

As shown in FIGS. 2, 3 and 4, the sector assembly 30 is disposed in the second open chamber 121 of the second housing base 12. The sector assembly 30 includes a locking unit 31, a plurality of fan ribs 32, and a fan cloth 33. The fan cloth 33 is arc-shaped and adheres to the plurality of fan ribs 32. The plurality of fan ribs 32 is stacked together and locked by the locking unit 31 coaxially together. When the locking unit 31 is in an unlocked state, the plurality of fan ribs 32 can be stacked together after being folded. After unfolding, the plurality of fan ribs 32 and the fan cloth 33 form an arc-shaped fan. When the locking unit 31 is in the locked state, the plurality of fan ribs 32 will be firmly fixed together.

Figure 7:
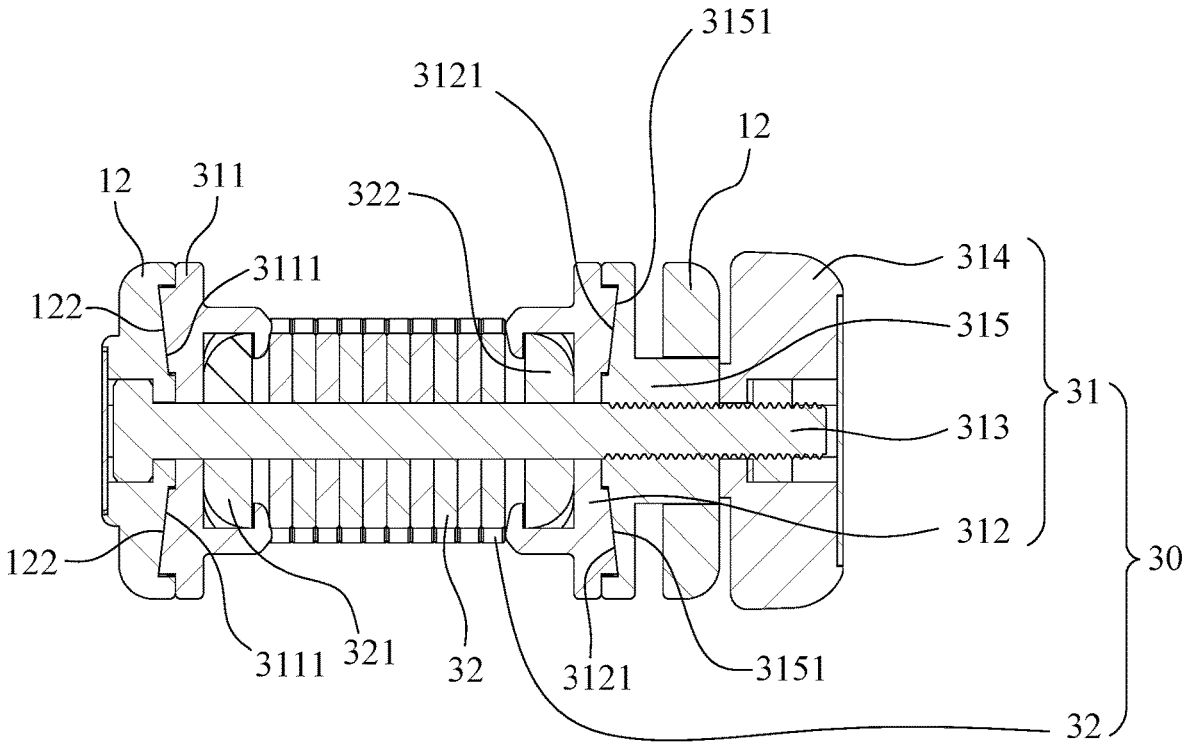
FIG. 7 is an enlarged cross-sectional view of plane BB in FIG. 1.

Since the present invention is applied to the golf swing execution, in order to further ensure that the fan ribs 32 will not be easily folded together during the swing process, the present invention uses a locking unit 31 with a special structure. The two outermost sides of the fan ribs 32 are respectively designated as a first side fan rib 321 and a second side fan rib 322. The locking unit 31 includes a first fixing member 311, a second fixing member 312, a locking screw 313, and a locking knob 314. The first fixing member 311 is used to fix one end of the first side fan rib 321, the second fixing member 312 is used to fix one end of the second side fan rib 322 at the corresponding position, the locking screw 313 penetrates the second housing base 12 to connect the first fixing member 311, the first side fan rib 321, the rest of the plurality of the fan ribs 32, the second side fan ribs 322, and the second fixing member 312 together in series to be screwed and locked by the locking screw 313 and the locking knob 314, as shown in FIG. 7, whereby when the locking knob 314 is tightened, the positions of the plurality of fan ribs 32 is fixed. The first fixing member 311 can be directly fixed to the first side fan rib 321 in an adhesive manner, or as in the present embodiment, the first fixing member 311 has a first fixing groove 3112, and the shape of the first fixing groove 3112 matches that of the first side fan ribs 321 to facilitate the first side fan ribs 321 to be installed in the first fixing groove 3112. Similarly, the second fixing member 312 also has a second fixing groove 3122, and the shape of the second fixing groove 3122 matches that of the second side fan ribs 322 to facilitate the second side fan ribs 322 to be installed in the second fixing groove 3122.

In addition, in order to ensure that the first fixing member 311 will not rotate randomly when locked, the second housing base 12 has a first side tooth surface 122 facing the inner wall of the first fixing member 311. The wall surface of the first fixing member corresponding to the first side tooth surface 122 has a first tooth surface 3111. In the locked state, the first side tooth surface 122 meshes with the first tooth surface 3111. In addition, an auxiliary member 315 is provided on the second housing base 12 in the direction facing the second fixing member 312. The auxiliary member 315 has a second side tooth surface 3151 facing the wall surface of the second fixing member 312. The wall surface of the second fixing member 312 facing the second side tooth surface 3151 has a second tooth surface 3121. In the locked state, the second side tooth surface 3151 will mesh with the second tooth surface 3121. This ensures that the locking unit 31 can reliably fix the positions of the first side fan ribs 321, the plurality of fan ribs 32, and the second side fan ribs 322 when locked.

Figure 8:
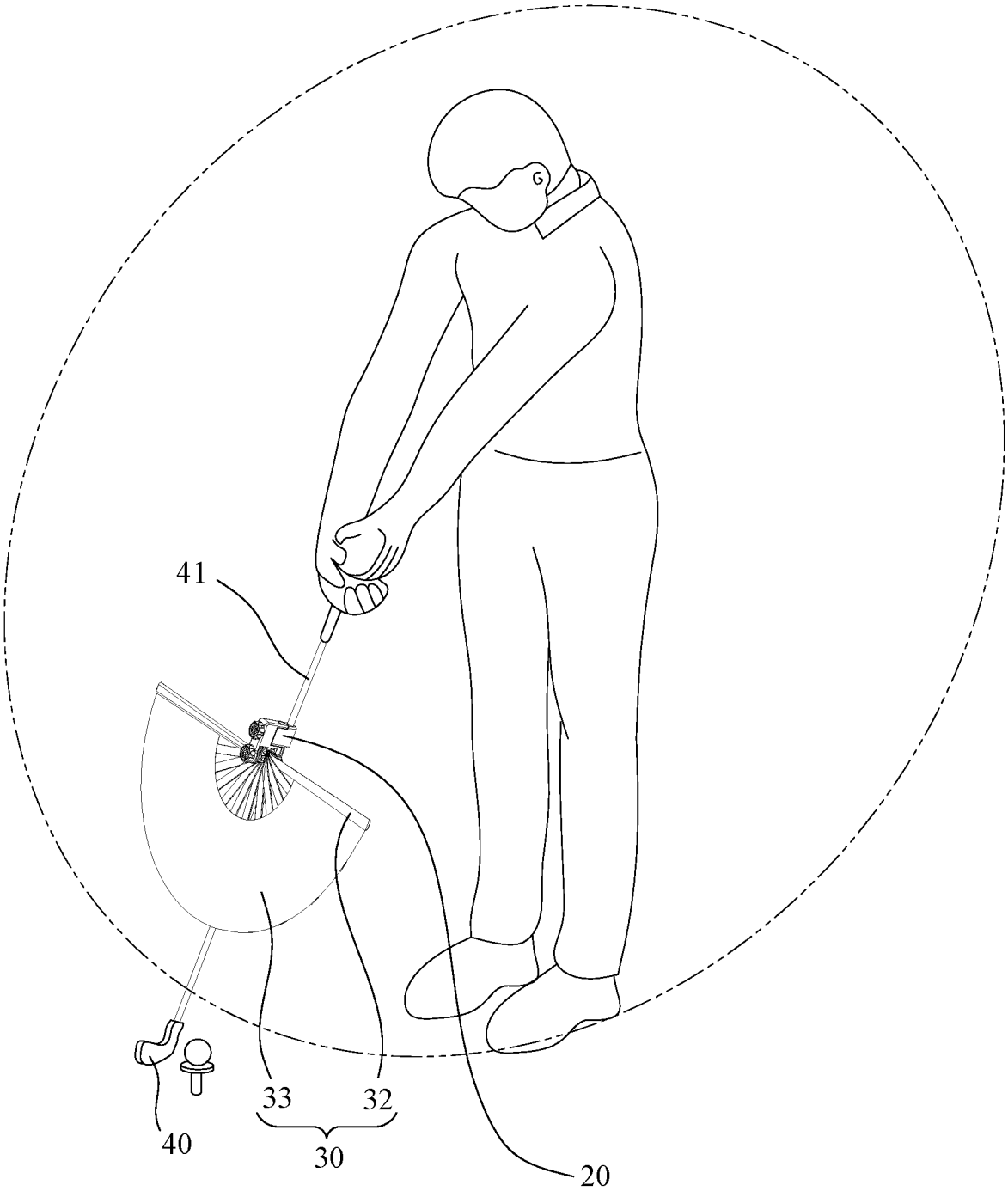
FIG. 8 is a schematic view of the swing action when the present invention is fixed on the club.

The following explains the actual action diagram of the present invention. As shown in FIG. 8, the sector assembly 30 is first unfolded, and the fan ribs 32 are fixed together in the locked state of the locking unit 31. The fan cloth 33 is unfolded to form an arc-shaped fan surface, and then the clamping assembly 20 is used to clamp the pair of clamps 21 on the shaft 41 of the club 40. When the user swings, the imaginary line in the figure resembles an elliptical trajectory, which is the correct swing path of the club 40. The arc surface formed by the sector assembly 30 is used to reach the backswing position after taking off the club, or during the downswing from the backswing position, impacting the ball, and then follow-through, the arc-shaped fan cloth 33 will guide the club 40 to smoothly swing along the elliptical trajectory, and the correct swing posture is maintained during the swing execution, thereby making the correct swing posture becoming a habit.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An auxiliary device for practicing golf swing posture, comprising:

a housing, having a first housing base and a second housing base in an open manner;

a clamping assembly, installed on the first housing base, and for clamping onto a shaft of a golf club; and a sector assembly, folded and stacked into an elongated square multi-layered structure forming a sector-shaped fan after unfolding.

2. The auxiliary device for practicing golf swing posture according to claim 1, wherein the clamping assembly comprises a pair of clamps and a control knob; the pair of clamps is disposed on the first housing base and can be opened or closed; the control knob is disposed on the first housing base and is connected with the pair of clamps; when the control knob rotates, the pair of clamps is opened or closed.

3. The auxiliary device for practicing golf swing posture according to claim 2, wherein a semi-circular arc-shaped jaw is disposed respectively on a wall surface of each of the pair of clamps facing each other.

4. The auxiliary device for practicing golf swing posture according to claim 2, wherein an elastic member is disposed at a pivot joint of the pair of clamps and the first housing base, the elastic member is in contact with the pair of clamps and the pair of clamps is driven by the elastic member to open in the absence of external force.

5. The auxiliary device for practicing golf swing posture according to claim 2, wherein the clamping assembly further comprises a top latch, located in the first housing base and able to move over a preset distance without breaking away; the top latch is embedded with a nut, and the control knob is provided with a screw; after assembly, the screw penetrates the first housing base and extends into the first housing base to connect with the nut; the screw is driven to rotate by rotating the control knob, and the top latch is synchronously driven to move because the screw is connected to the nut.

6. The auxiliary device for practicing golf swing posture according to claim 5, wherein the pair of clamps has an inclined surface facing an end connecting to the top latch, the top latch has a guide surface with double inclined surfaces corresponding to each inclined surface respectively, and the pair of clamps is opened or closed according to different contact states between the guide surface and the inclined surfaces of the clamps.

7. The auxiliary device for practicing golf swing posture according to claim 1, wherein the sector assembly comprises a locking unit, a plurality of fan ribs and a fan cloth; the fan cloth is arc-shaped and adheres to the plurality of the fan ribs, and the fan ribs are stacked together with one end locked together by the locking unit; when the locking unit is in an unlocked state, the plurality of fan ribs stack together after folding and form an arc-shaped fan by unfolding the fan ribs and the fan cloth; and, when the locking unit is in a locked state, the positions of the plurality of fan ribs are fixed together.

8. The auxiliary device for practicing golf swing posture according to claim 7, wherein both sides of the outermost periphery of the plurality of fan ribs are respectively a first side fan rib and a second side fan rib, the locking unit comprises a first fixing member, a second fixing member, a locking screw, and a locking knob, the first fixing member is fixed on one end of the first side fan rib, the second fixing member is fixed on one end of the second side fan rib at a corresponding position, and the first fixing member and the second fixing member are clamped to the first side fan rib, the reset of the plurality of the fan ribs and the second side fan rib, the locking screw penetrates the second housing base to secure the first fixing member, the first side fan rib, the rest of the plurality of fan ribs, the second side fan rib, and the second fixing member connected in series, and the locking screw is screwed to the locking knob.

9. The auxiliary device for practicing golf swing posture according to claim 8, wherein a wall surface of the second housing base facing the first fixing member has a first side tooth surface, the first fixing member facing the wall surface of the first side tooth surface has a first tooth surface, and the first side tooth surface meshes with the first tooth surface when the locking unit is locked.

10. The auxiliary device for practicing golf swing posture according to claim 8, wherein an auxiliary member is disposed on the second housing base in a direction facing the second fixing member, a wall surface of the auxiliary member facing the second fixing member has a second side tooth surface, a wall surface of the second fixing member facing the second side tooth surface has a second tooth surface, and the second side tooth surface meshes with the second tooth surface when the locking unit is locked.

* * * * *